US007433478B2

(12) United States Patent
Chang

(10) Patent No.: US 7,433,478 B2
(45) Date of Patent: Oct. 7, 2008

(54) MICROPHONE PICK-UP DEVICE

(75) Inventor: Chao-Chih Chang, Taichung (TW)

(73) Assignee: Taiwan Carol Electronics Co., Ltd., Taichung (TW)

( * ) Notice: Subject to any disclaimer, the term of this patent is extended or adjusted under 35 U.S.C. 154(b) by 574 days.

(21) Appl. No.: 11/051,676

(22) Filed: Feb. 4, 2005

(65) Prior Publication Data

US 2006/0098834 A1 May 11, 2006

(51) Int. Cl.
*H04R 25/00* (2006.01)

(52) U.S. Cl. ..... 381/177; 381/170

(58) Field of Classification Search ..... 381/170, 381/171, 177, 355, 356, 357, 360, 361
See application file for complete search history.

(56) References Cited

U.S. PATENT DOCUMENTS 6,226,386 B1 * 5/2001 Akino ..... 381/355

6,477,257 B1 * 11/2002 Chang ..... 381/355

* cited by examiner

*Primary Examiner*—Brian Ensey
(74) *Attorney, Agent, or Firm*—McNees Wallace & Nurick, LLC

(57) ABSTRACT

A microphone pick-up device includes an air chamber unit disposed posteriorly of an annular cap body. A pick-up unit generates an acoustic signal in response to detected sound, and includes a yoke mounted in a front portion of the cap body, a voice coil disposed around a washer and a magnet within the yoke, a diaphragm for covering the yoke and connected to the voice coil, a sound regulating cloth attached to and disposed to surround the cap body, and a sound regulating paper disposed between a rear portion of the cap body and the air chamber unit and covering an air passage unit of the cap body. A signal filter is disposed between the rear portion of the cap body and the air chamber unit, is disposed posteriorly of the sound regulating paper, and is coupled to the voice coil for filtering noise in the acoustic signal.

2 Claims, 4 Drawing Sheets

MICROPHONE PICK-UP DEVICE

BACKGROUND OF THE INVENTION

1. Field of the Invention

The invention relates to a microphone pick-up device, more particularly to a microphone pick-up device having a signal filter.

2. Description of the Related Art

Performance for a microphone depends on a consistent sensitivity. A conventional dynamic microphone generates an acoustic output that has a frequency response with a large variance, as indicated by a curve (L1) of FIG. 4, thereby resulting in an inconsistent sensitivity. Particularly, distortion for high frequency signals is likely to occur.

SUMMARY OF THE INVENTION

Therefore, the object of the present invention is to provide a microphone pick-up device that has an improved frequency response so as to ensure performance with a substantially consistent sensitivity.

According to the present invention, a microphone pick-up device comprises:

an annular cap body having a front potion, a rear portion and an air passage unit;

an air chamber unit disposed posteriorly of the cap body;

a pick-up unit for generating an acoustic signal in response to detected sound, the pick-up unit including a yoke mounted in the front portion of the cap body, a magnet disposed in the yoke, a washer disposed in the yoke and in front of the magnet, a voice coil disposed around the washer and the magnet within the yoke, a diaphragm disposed in front of the washer for covering the yoke and connected to the voice coil, a sound regulating cloth attached to and disposed to surround the cap body, and a sound regulating paper disposed between the rear portion of the cap body and the air chamber unit and covering the air passage unit; and a signal filter disposed between the rear portion of the cap body and the air chamber unit and disposed posteriorly of the sound regulating paper, the signal filter being coupled to the voice coil and being adapted for filtering noise in the acoustic signal.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
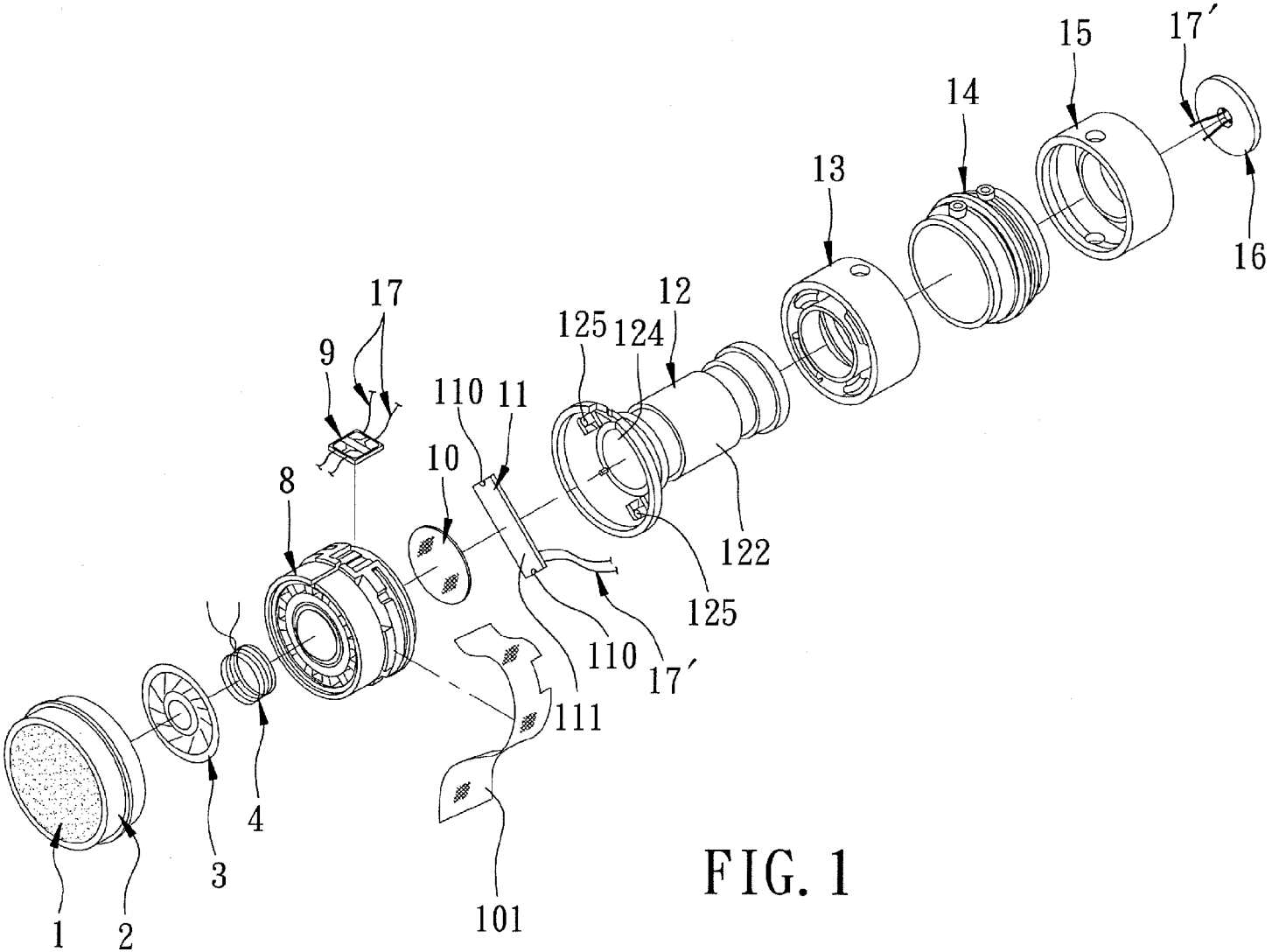
FIG. 1 is an exploded perspective view showing the preferred embodiment of a microphone pick-up device according to this invention.
Figure 2:
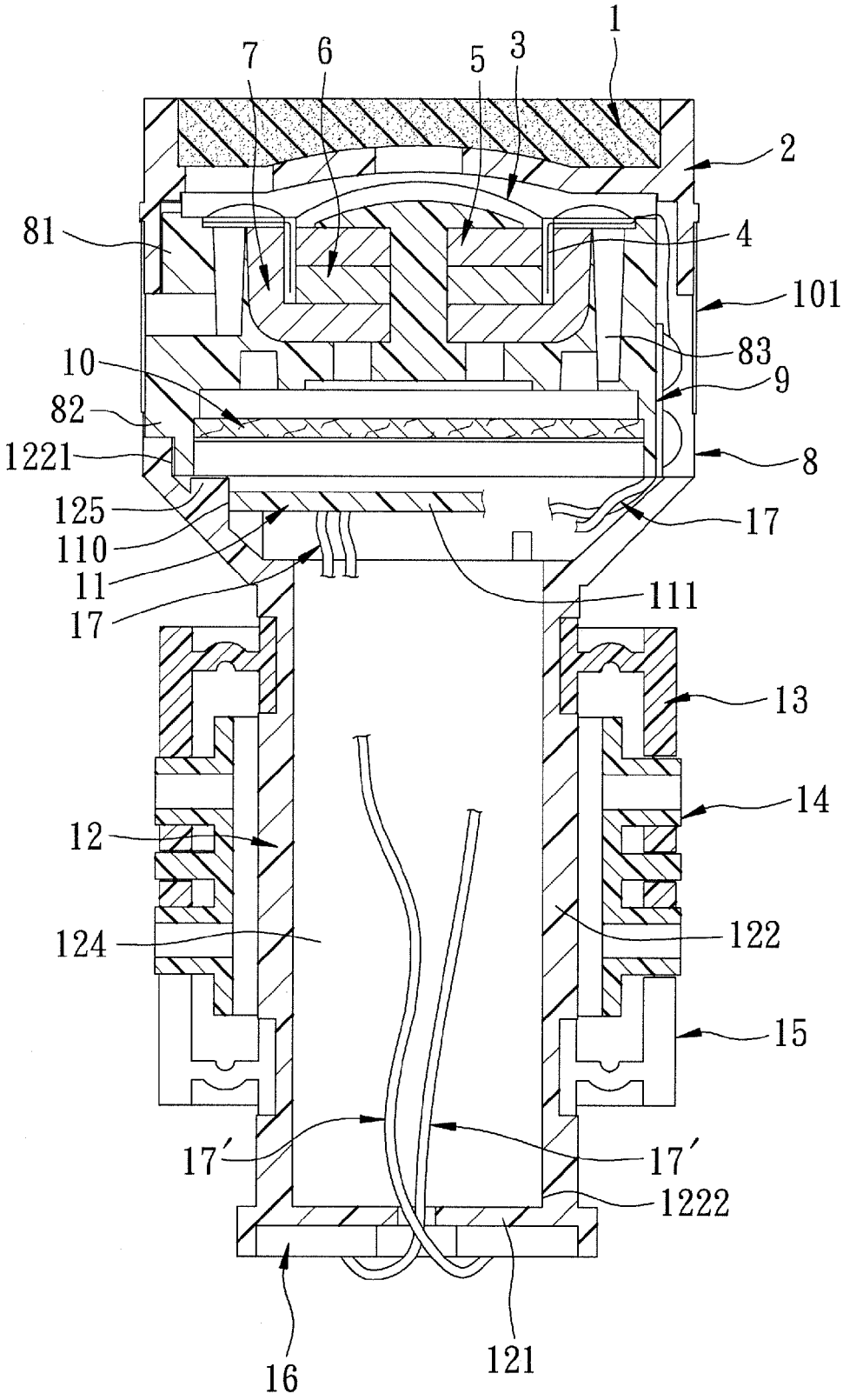
FIG. 2 is a schematic sectional view showing the preferred embodiment.

Referring to FIGS. 1 and 2, the preferred embodiment of a microphone pick-up device according to the present invention is shown to include an annular cap body 8, an air chamber unit 12, a pick-up unit, a protective cover 2, and a signal filter 11.

The cap body 8 has a front portion 81, a rear portion 82, and an air passage unit 83, as shown in FIG. 2.

The air chamber unit 12 is disposed posteriorly of the cap body 8. In this embodiment, the air chamber unit 12 has a surrounding wall 122 with front and rear ends 1221, 1222, and an end wall 121 disposed to close the rear end 1222 of the surrounding wall 122 and cooperating with the surrounding wall 122 so as to confine an air chamber 124. The front end 1221 of the surrounding wall 122 is connected to the rear portion 82 of the cap body 8, as shown in FIG. 2. In this embodiment, a coupling sleeve 14 is sleeved on the surrounding wall 122 for coupling front and rear cushioning rings 13, 15, which are sleeved on the surrounding wall 122, as shown in FIG. 2.

The pick-up unit is used for generating an acoustic signal in response to detected sound. The pick-up unit includes a yoke 7 mounted in the front portion 81 of the cap body 8, a magnet 6 disposed in the yoke 7, a washer 5 disposed in the yoke 7 and in front of the magnet 6, a voice coil 4 disposed around the washer 5 and the magnet 6 within the yoke 7, a diaphragm 3 disposed in front of the washer 5 for covering the yoke 7 and connected to the voice coil 4, a sound regulating cloth 101 attached to and disposed to surround the cap body 8, and a sound regulating paper 10 disposed between the rear portion 82 of the cap body 8 and the air chamber unit 12 and covering the air passage unit 83.

The protective cover 2 is coupled to the front portion 81 of the cap body 8, and is mounted with a sponge 1 on top thereof.

Figure 3:
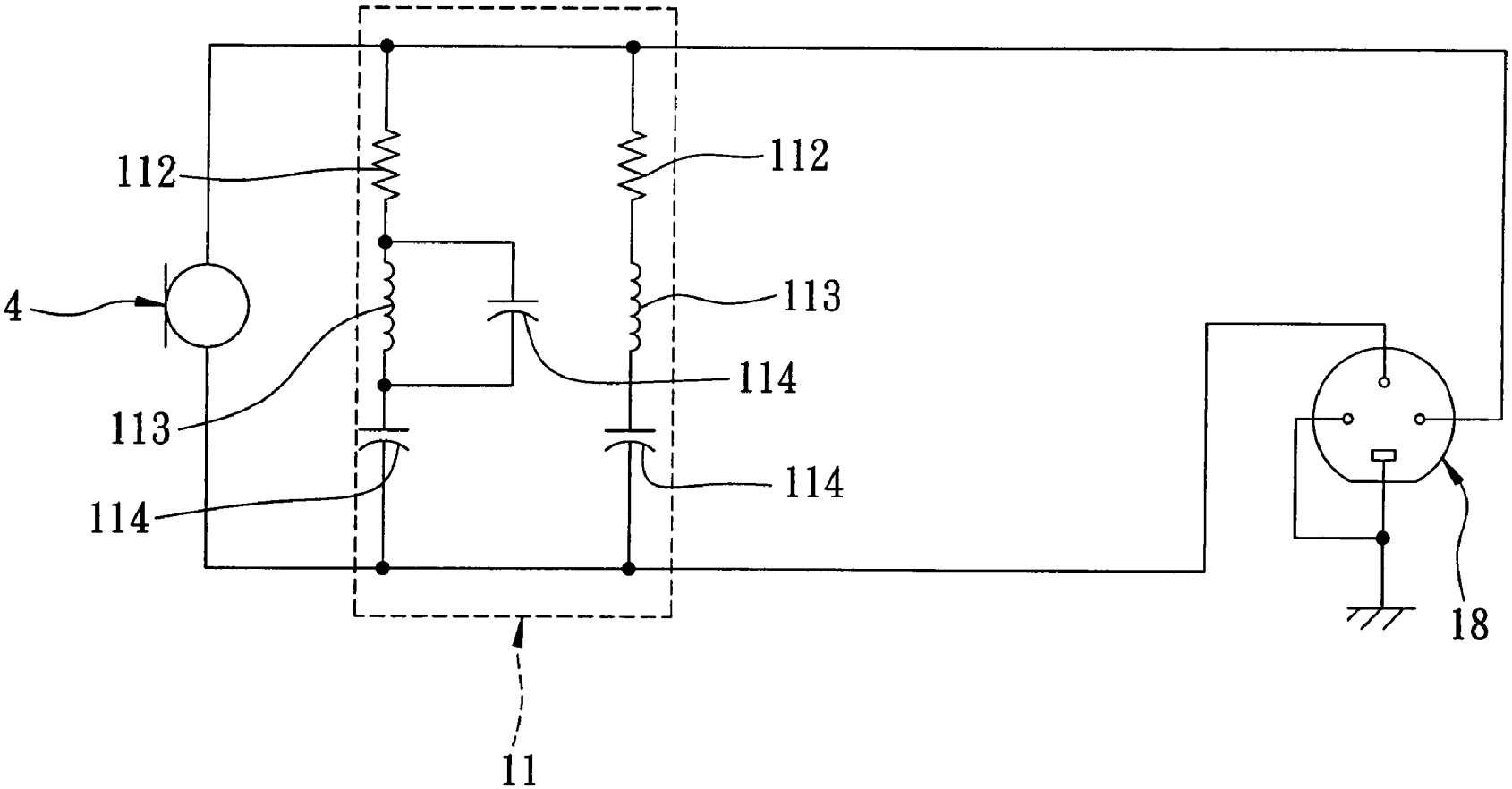
FIG. 3 is a schematic electrical circuit diagram illustrating a signal filter of the preferred embodiment.

The signal filter 11 is disposed between the rear portion 82 of the cap body 8 and the air chamber unit 12, and is disposed posteriorly of the sound regulating paper 10. The signal filter 11 is coupled to the voice coil 4 via a first coupling board 9 with wirings 17, and is adapted for filtering noise in the acoustic signal. In this embodiment, the signal filter 11 includes a circuit board 111 provided with a plurality of resistors 112, inductors 113 and capacitors 114 thereon, as shown in FIG. 3. The signal filter 11 is further coupled to a second coupling board 16 mounted on the end wall 121 of the air chamber unit 12 by wirings 17' (see FIG. 2) such that the signal filter 11 is adapted to be coupled to a 3-terminal contact 18 (see FIG. 3) via the second coupling board 16. In this embodiment, the surrounding wall 122 is formed with a positioning member that is disposed in the front end 1221 and that includes two positioning pins 125 engaging respectively opposite notches 110 formed in the circuit board 111 of the signal filter 11, thereby positioning the signal filter 11 in the front end 1221.

Figure 4:
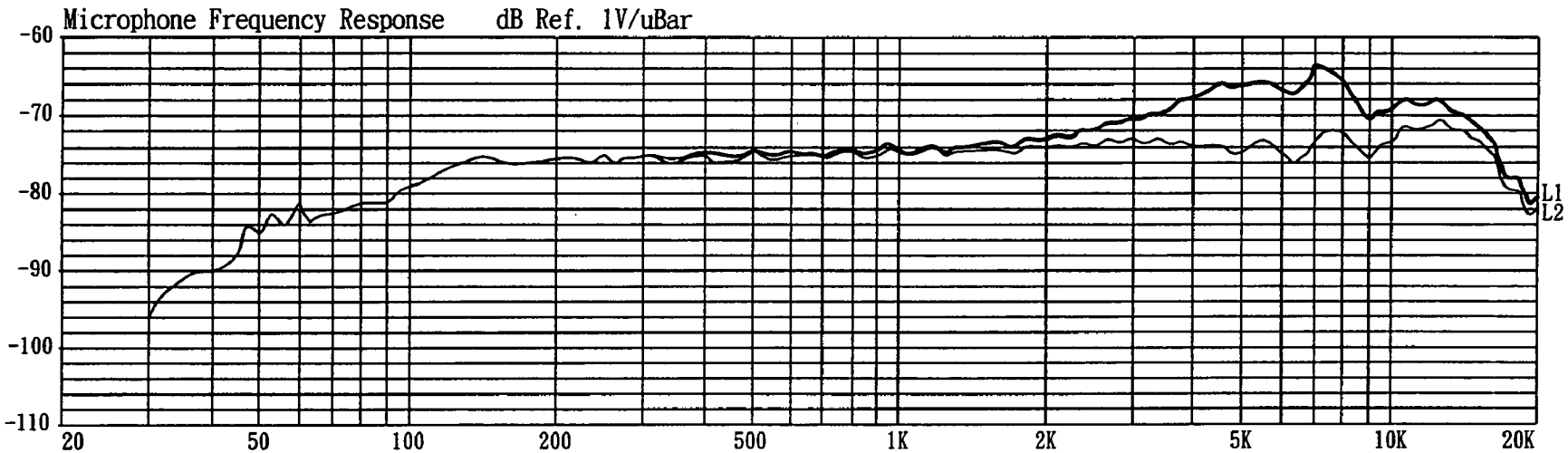
FIG. 4 is a plot illustrating experimental results of measured frequency response to compare performance of the preferred embodiment with a conventional dynamic microphone.

Due to the presence of the signal filter 11, the microphone pick-up device of this invention can provide an improved frequency response. With reference to FIG. 4, based on experimental results of measured frequency response to compare performance of the microphone pick-up device of this invention with the conventional dynamic microphone without the aforesaid signal filter 11, the frequency response (L1) for the conventional dynamic microphone changed sharply from −75 dB to −63 dB within a high frequency band, such as 2 KHz~20 KHz, whereas the frequency response for the microphone pick-up device of this invention and indicated by a curve (L2) varies relatively smoothly within the high frequency band, and substantially remains about −75 dB when varying from a low frequency band to the high frequency band. As such, the microphone pick-up device of this invention can provide an improved frequency response so as to ensure performance with a substantially consistent sensitivity.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A microphone pick-up device comprising:

an annular cap body having a front portion, a rear portion and an air passage unit;

an air chamber unit disposed posteriorly of said cap body;

a pick-up unit for generating an acoustic signal in response to detected sound, said pick-up unit including a yoke mounted in said front portion of said cap body, a magnet disposed in said yoke, a washer disposed in said yoke and in front of said magnet, a voice coil disposed around said washer and said magnet within said yoke, a diaphragm disposed in front of said washer for covering said yoke and connected to said voice coil, a sound regulating cloth attached to and disposed to surround said cap body, and a sound regulating paper disposed between said rear portion of said cap body and said air chamber unit and covering said air passage unit;

a signal filter disposed between said rear portion of said cap body and said air chamber unit and disposed posteriorly of said sound regulating paper, said signal filter being coupled to said voice coil and being adapted for filtering noise in the acoustic signal; and wherein said air chamber unit has a surrounding wall with front and rear ends, and an end wall disposed to close said rear end of said surrounding wall and cooperating with said surrounding wall so as to confine an air chamber, said front end of said surrounding wall being connected to said rear portion of said cap body, said surrounding wall being formed with a positioning member disposed in said front end for positioning said signal filter therein.

2. The microphone pick-up device as claimed in claim 1, wherein said signal filter includes a circuit board provided with a plurality of resistors, inductors and capacitors thereon.

* * * * *